252-99 AU 166 EX
3/14/78 XR 4,079,015

United States Patent [19]
Paucot et al.
[11] 4,079,015
[45] Mar. 14, 1978

[54] LIQUID DETERGENT COMPOSITIONS

[75] Inventors: André Paucot; Alain Decamps, both of Brussels, Belgium

[73] Assignee: Solvay & Cie., Brussels, Belgium

[21] Appl. No.: 663,205

[22] Filed: Mar. 2, 1976

[30] Foreign Application Priority Data

Mar. 6, 1975 Luxembourg ..... 71985

[51] Int. Cl.² ..... C11D 3/20; C11D 7/26

[52] U.S. Cl. ..... 252/95; 252/89 R; 252/99; 252/102; 252/103; 252/DIG. 2; 252/DIG. 11; 252/DIG. 15

[58] Field of Search ..... 252/94, 95, 99, 89, 252/102, 103, DIG. 15, DIG. 11, DIG. 2

[56] References Cited

U.S. PATENT DOCUMENTS 3,658,712 4/1972 Lindner et al. ..... 252/99
3,730,913 5/1973 Oba et al. ..... 252/DIG. 15
3,850,832 11/1974 Wegemund et al. ..... 252/99
3,920,570 11/1975 Mulders ..... 252/89

*Primary Examiner*—Mayer Weinblatt
*Attorney, Agent, or Firm*—Spencer & Kaye

[57] ABSTRACT

A stable liquid detergent composition comprises a peroxide derivative, at least one surface-active agent, a salt of a polymer derived from an alpha-hydroxyacrylic acid, which salt contains units of the formula

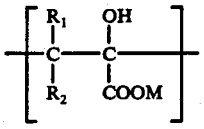

wherein $R_1$ and $R_2$ independently represent hydrogen atoms or alkyl groups containing from 1 to 3 carbon atoms which may or may not be substituted and where M represents a cationic radical resulting from the dissociation of a base, and at least one solvent.

18 Claims, No Drawings

LIQUID DETERGENT COMPOSITIONS

BACKGROUND OF THE INVENTION

The present invention relates to liquid detergent compositions which are stable in the presence of hydrogen peroxide.

It also relates to processes for their preparation and their use.

The detergent compositions which can be marketed in a liquid form usually contain, in addition to the solvent (which may be water or an organic solvent), surface-active agents, builders, which are frequently phosphorus derivatives and especially phosphates, and various other adjuvants which render the liquid homogeneous and stable and impart to it certain properties which depend on the particular use for which they are intended.

These compositions can be in the form of liquid solutions. emulsions or suspensions and may optionally contain solid particles.

In order to improve the performances of these liquid compositions, it has been proposed to add to them peroxide derivatives and more especially hydrogen peroxide.

However, the introduction of such compounds entails serious difficulties; the liquids tend to separate into several phases during storage and their active oxygen content decreases with time. Several proposals have been advanced in order to solve these problems, such as the use of stabilizers and of two separate compositions which are mixed at the time of use. None of these proposals, however, has proved satisfactory, either because the physical and chemical stability of the composition was still inadequate or because the detergency was inadequate, or because the method of use was rather impractical.

SUMMARY OF THE INVENTION

There has now been found, in accordance with the present invention, a liquid detergent composition which, though it contains hydrogen peroxide, does not exhibit the disadvantages indicated above.

The present invention, as embodied and broadly described, provides a stable liquid detergent composition which comprises a peroxide derivative, at least one surface-active agent, a salt of a polymer derived from an alpha-hydroxyacrylic acid, which salt contains units of the formula

I.

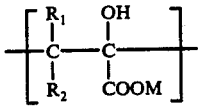

where $R_1$ and $R_2$ independently represent hydrogen or an alkyl group containing from 1 to 3 carbon atoms which may or may not be substituted, and where M represents a cationic radical resulting from the dissociation of a base, and at least one solvent. When $R_1$ and $R_2$ independently represent a substituted alkyl group, the substituent may be an hydroxyl group or an halogen atom.

DETAILED DESCRIPTION OF THE INVENTION

The polymer salts used according to the present invention are preferably polymers as defined above in which $R_1$ and $R_2$ represent hydrogen or a methyl group and $R_1$ and $R_2$ can be identical or different. The best results are obtained with polymers where $R_1$ and $R_2$ represent hydrogen.

The polymers used in the present invention are selected from the group consisting of the homopolymers and copolymers which contain units as defined in formula I above, these units being of the same type or of several different types. If copolymers are used, they are most frequently chosen from among those which contain at least 50% of units as defined in formula I above and, preferably, from among those which contain at least 65% of similar units. The best results are obtained with polymers which only contain units such as those defined in formula I above.

The average molecular weight of the polymers employed in the practice of the present invention is greater than about 300. In general, it is between 2,000 and 1,000,000. The best results are obtained if it is between about 5,000 and about 800,000.

The copolymers which can be used include those which contain units derived from vinyl monomers which are substituted by one or more groups selected from the group consisting of hydroxyl and carboxyl groups. Advantageously, these copolymers contain acrylic units of the formula

II.

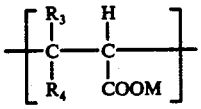

where $R_3$ and $R_4$ represent a hydrogen atom or an alkyl group containing from 1 to 3 carbon atoms and where M represents a cationic radical resulting from the dissociation of a base and has the same meaning as in formula I above. Among these copolymers, it is preferred to use those which contain acrylic units derived from unsubstituted acrylic acid, where $R_3$ and $R_4$ represent hydrogen.

The polymers used according to the present invention are salts derived from any organic or inorganic base. It is advantageous to use the salts of inorganic bases, such as alkali metal hydroxides or ammonium hydroxides. It is also possible to use salts of nitrogen-containing organic bases of the aliphatic type, which comprise a nitrogen atom substituted by one or more alkyl chains containing from 1 to 6 carbon atoms which may or may not be substituted. Examples of such bases are monoethanolamine or diethanolamine. It is also possible to use salts of nitrogen-containing organic bases of the alicyclic or aromatic type, which may or may not contain the nitrogen atom in the ring. The salts of alkali metal hydroxides and of ammonium hydroxides are particularly suitable. The best results are obtained with the sodium, ammonium and potassium salts.

Particularly suitable polymers are therefore sodium, potassium and ammonium poly-alpha-hydroxyacrylates.

The polymers used according to the present invention can be prepared by any known process. An example of the preparation of these polymers is described in Belgian Pat. No. 817,678, filed on July 15th, 1974 in the name of Solvay & Cie., and hereby incorporated by reference.

The liquid detergent compositions according to the present invention contain a peroxide compound. The peroxide compound is selected from the group consisting of hydrogen peroxide and the addition products of hydrogen peroxide. Hydrogen peroxide itself is very particulary suitable. The addition products of hydrogen peroxide are selected from among those with organic compounds or those with compounds of the inorganic type which are such that in the composition according to the invention the concentration of alkali metal ions in the free state (where they are completely dissociated) does not exceed 10 g, and preferably 5 g, per kg of solvent. If the concentration of alkali metal ions in the free state in the solvent is high, a phase separation effect is observed. Among the above addition compounds, urea peroxide is particularly suitable.

The liquid detergent compositions according to the invention can be in the form of solutions, emulsions or suspensions of liquids and can optionally contain solid particles. They are liquid, that is to say, they comprise a continuous liquid or pasty phase and can be poured from one receptacle into another. Various solvents can be used to serve as the liquid base for the compositions. Usually, water is employed as the solvent, and, if appropriate, the water is mixed with water-soluble compounds which make it possible to keep the active substances in solution, emulsion or suspension. These liquids and such water-soluble compounds do not have a particular washing or cleaning effect but they do make it possible to control the homogeneity or viscosity of the compositions. Thus, it is possible to mix the water with other solvents which, for example, make it possible to vary the viscosity of the composition, such as, for example, alcohols, or with compounds which disorganize the structure of the water, such as, for example, urea or formamide. These water-soluble compounds can be added to the water in varying amounts, but always within the limits of their solubility in water. Usually, less than 50% and most frequently less than 30% by weight of these water-soluble compounds, relative to the total weight of solvent, are employed. In the case of the addition of alcohols to water, amounts of alcohol of less than 15% by weight, relative to the total weight of solvent, are generally used, so as to avoid phase separation.

Though water is the most frequently used solvent, other solvents, such as organic solvents, can also be suitable. These other solvents in particular include hydroxyl or alkoxy derivatives.

In addition to the salts of polymers derived from alphahydroxyacrylic acids, the peroxide derivative and the solvent, the compositions according to the invention also contain at least one surface-active agent.

This surface-active agent can be selected from the group of non-ionic, anionic, cationic or amphoteric surface-active agents. In general, a mixture of surface-active agents is used. This mixture advantageously contains at least one non-ionic surface-active agent.

Numerous non-ionic surface-active agents can be used. These surface-active agents usually contain ether, hydroxyl, amine-oxide, sulfoxide or phosphine-oxide groups, or alkylolamide groups, in their structure.

Certain of these surface-active agents which are of particular interest are formed by the condensation of polyol-ethers with long-chain alcohols, fatty acids, fatty amines, fatty acid amides, alkylphenols or sulfonic acids. Usually, these condensation products contain from 2 to 100 ether groups, and preferably from 3 to 60 ether groups, per molecule, while the alkyl chains in general contain from 8 to 20 carbon atoms.

Condensates which are particularly valuable to use are the reaction products of ethylene oxide, propylene oxide or glycidols with alcohols or fatty acids.

It is alo possible to use, as non-ionic surface-active agents, the addition products of polyoxyethylene or polypropylene glycol, the reaction products of mono-, di- or poly-hydroxyalkylamines with polyhydroxycarboxylic acids or polyhydroxycarboxylic acid amides, or amine-oxides or oxysulfides which contain a long alkyl chain (which can contain from 10 to 20 carbon atoms) and are optionally oxyethylated.

Though non-ionic surface-active agents are preferred for the production of the compositions of the invention, these compositions can nevertheless contain other types of surface-active agents.

The anionic surface-active agents which can be incorporated into the compositions of the present invention in particular include the sulfonates and sulfates, such as the alkylarylsulfonates, for example, dodecylbenzenesulfonates, the alkylethylsulfonates, the alkenylsulfonates, the alkylsulfonates, the alkyl-sulfates, the esters of fatty alpha-sulfoacids, the sulfates of oxyethylated alcohols or amides, and the like. Other suitable anionic surface-active agents are the alkali metal soaps of fatty acids of natural or synthetic origin. The anionic surface-active agents may be in the form of sodium, potassium or ammonium salts, or of salts of organic bases. Within the scope of the present invention, it is preferred to use the surface-active agents in the form of salts of organic bases, such as monoethanolamine, diethanolamine or triethanolamine.

As examples of cationic surface-active agents, there may in particular be mentioned octadecylamine hydrochloride as well as other derivatives, of the quaternary ammonium type, of amines with long linear chains containing from 8 to 18 carbon atoms.

The ampholytic and amphoteric surface-active agents can comprise derivatives, such as 3-(N,N-dimethyl-N-hexadecylammonio)-propane-1-sulfonate or 3-(N,N-dimethyl-N-hexadecylammonio)-2-hydroxy-propane-1-sulfonate, the alkylsulfobetaines, the amidoalkenesulfonates, aliphatic amines substituted by a carboxyl, sulfo, phosphate or phosphino group, and the like.

This list of surface-active agents is given by way of example and surface-active agents other than those indicated above can also be used. For example, surface-active agents mentioned in the book, *Surface-Active Agents*, by A. M. Schwarz and J. W. Perry, can also be used.

The foaming power of the surface-active agents can be adjusted to the desired value by using appropriate combinations of surface-active agents. The foaming power can also be modified by adding foam regulators which are not of the surface-active agent type.

The compositions according to the present invention can also contain other substances chosen in accordance with the special field of application of the composition.

Among these other substances, there may be mentioned optical bluing agents, enzymes, tarnishing inhibitors, agents to counteract soil redeposition, disinfectants, corrosion inhibitors, perfumes, dyestuffs, pH regulators, agents capable of liberating active chlorine, and abrasives.

Enzymes used are, for example, those from the category of the proteases, lipases and amylases.

Tarnishing inhibitors and agents to counteract soil redeposition which are used are, for example, benzotriazole or ethylenethiourea and carboxymethylcellulose or polyvinylpyrrolidone.

As agents capable of liberating active chlorine, there may be mentioned the organic N- chloro compounds, such as trichloroisocyanuric acid or N-chlorobenzenesulfonamide or N-chlorotoluene-sulfonamide.

The pH regulators used are, in general, basic water-soluble organic compounds, such as, for example, triethanolamine, or inorganic compounds, such as silicates, provided their presence does not result in too high a concentration of alkali metal ions in the free state in the solution.

As optical bluing agents, it is possible to use, in particular, derivatives of stilbene, coumarine or 3-phenyl-7-aminocarbostyril, or 1,3-diaryl-pyrazolines. It is also possible to use dyestuffs having a yellow fluorescence, such as diphenyl yellow.

The salts of polymers derived from alpha-hydroxyacrylic acids, used in accordance with the present invention, are known to be excellent builders, as disclosed in Belgian Pat. No. 776,705, filed on Dec. 15th, 1971 in the name of Solvay & Cie., which patent is hereby incorporated by reference. However, it is possible to add, to the compositions according to the present invention, other known builders, such as complexing agents of the organic type, such as, for example, those derived from nitrilotriacetic acid, ethylenediaminetetraacetic acid, polyalkylene-polyamine-N-polycarboxylic acids or phosphonic acids substituted by organic groups.

The total amount of active constituents in the compositions according to the present invention in general represents less than 80% by weight, and most frequently from 5 to 60% by weight, of the composition. The balance consists of solvents which optionally contain compounds which make it possible to control the homogeneity or the viscosity of the compositions. Very dilute compositions may, of course, be suitable but they are less interesting from an economic point of view because, for comparable efficiency, the volumes of these compositions which must be employed become very large.

The content of active constituents in the compositions according to the present invention is in general the following:

from 0.1 to 30%, and preferably from 1 to 20%, by weight of hydrogen peroxide, taken as 100% strength, from 20 to 95%, and preferably from 30 to 80%, by weight of surface-active agent, from 0.5 to 50%, and preferably from 5 to 40%, by weight of salts of polymers derived from alpha-hydroxyacrylic acids, from 0 to 70% by weight of other compounds usually employed in detergent compositions, broken down as follows:

from 0 to 30% by weight of optical bluing agents, from 0 to 20% by weight of pH regulators, and from 0 to 70% by weight of various substances which depend on the particular field of application of the composition.

The present invention also relates to the use of the liquid or pasty detergent compositions defined above for washing textiles and fibers or cleaning equipment, tanks, pipelines and surfaces of all kinds, whether for industrial or domestic uses, such as, for example, fine handwashing or machine washing, high temperature washing in drum-type machines, pre-washing and cleaning surfaces of ceramic, glass, metal, plastics, wood and the like.

The temperature at which the compositions according to the present invention can be used is generally between 0 and 130° C. In general, temperatures of between 15° and 105° C are employed. The temperature depends on the nature of the article which it is desired to wash or clean and of the technique used.

An example of a typical compostion which can be used for washing textiles and fibers contains: from 90 to 50% by weight of solvent (generally water), from 0.5 to 10% by weight of hydrogen peroxide, taken as 100% strength, from 5 to 30% by weight of surface-active agents, from 1 to 30% by weight of a salt of a polymer derived from an alpha-hydroxyacrylic acid, from 0.01 to 0.5% by weight of optical bluing agents, from 0.1 to 5% by weight of pH regulators, and optionally small amounts of dyestuffs and perfumes.

Such compositions are used at the rate of 1 to 50 g per liter of water at temperatures of between 10° and 110° C and for periods which can range from 2 to 100 minutes.

Compositions for scouring may, for example, contain: from 90 to 30% by weight of solvent (generally water), from 0.1 to 5% by weight of hydrogen peroxide, taken as 100% strength, from 1 to 20% by weight of surface-active agents, from 1 to 20% by weight of a salt of a polymer derived from an alpha-hydroxyacrylic acid, from 0.1 to 5% by weight of pH regulators, from 1 to 30% by weight of abrasives and from 0 to 5% by weight of compounds capable of liberating active chlorine.

The present invention furthermore relates to a process for the manufacture of the liquid detergent compositions defined above.

These compositions are obtained by dissolving, emulsifying or suspending the various active constituents in the solvent. This operation is carried out with vigorous stirring, in any manner which is in itself known. The means of stirring are, most frequently, of the rotary type and run at about 100 to 10,000 revolutions per minute. The temperatures used for the preparation of the compositions according to the present invention are in general between 0° and 50° C and preferably between 5° and 35° C.

A particularly efficient sequence of introducing the constituents of the composition into a mixer comprises first introducing all the solvent and then adding to the solvent the surface-active agents until solution is complete. The salts of polymers derived from alpha-hydroxyacrylic acids are then introduced into the solution at the same time as other additives, such as the buffers, and the eventual optical bluing agents. The hydrogen peroxide, usually in the form of a solution, is introduced last. In another particularly efficient sequence the polymer salts and the eventual optical bluing agents are introduced the last. Advantageously the solution is then kept during a few days before introducing these polymer salts.

The compositions which form the subject of the present invention have the advantage of possessing good physical stability, and good stability of the active oxygen, in spite of the use of a rather basic pH, and of having a relatively high content of active constituents, which makes it possible to achieve an efficiency comparable to that of commerical detergent powders for volumes of the same order of magnitude.

In order to better demonstrate the remarkable results obtained in accordance with the process of the present invention, there are given below some test results by way of examples and without implying a limitation.

EXAMPLE 1

This example illustrates the preparation of nine different liquid detergent compositions, identified herein as liquids $A_1$ to $A_9$, in accordance with the present invention. Each of these liquid detergent compositions was prepared as follows. The total amount of water is introduced into a vessel. A first non-ionic surface-active agent, which consists of an oxyethylated and oxypropylated $C_{12}$–$C_{16}$ alcohol (Plurafac B 26 or Ukanyl 75 sold by Ugine Kuhlman) is then added, and stirred until completely dissolved. A second non-ionic surface-active agent, which is a $C_{14}$–$C_{15}$ alcohol oxyethylated with 11 mols of ethylene oxide (Dobanol 45/11 sold by Shell) is introduced, while stirring. When solution is complete, a poly-alpha-hydroxyacrylate of which the average molecular weight is shown in Table I, a pH regulator (triethanolamine) and an optical bluing agent are added simultaneously. The mixture is again stirred until solution is complete, and finally a 70% strength aqueous solution of hydrogen peroxide is introduced. A liquid which only comprises one phase is thus obtained. The compositions of the various liquids thus obtained and a number of their properties are shown in Table I below.

If the poly-alpha-hydroxyacrylate is dissolved before the optical bluing agent, the appearance of a second phase is observed.

The physical stability of the liquid compositions was examined by storing the solutions for 2 months either at 32° C or at 43° C. All the liquid compositions proved stable at 32° C as shown by the symbol (S) in Table I. At 43° C, a slight cloudiness was observed, with spontaneous rehomogenization on cooling as shown by the symbol (R) in Table I.

The loss of active oxygen was calculated by comparing the active oxygen content after one month's storage at 32° C with the initial content after complete homogenization; this latter condition is reached after a time which varies, depending on the composition.

For reasons of standardization of the method, the initial strength was always measured after five days. The values observed, expressed in % by day (mean value calculated over one month) are shown in Table I. The values observed are generally less than 1% and in the most unfavorable case the loss of active oxygen reaches 1.5% per day.

The pH of the liquids was also examined and in all cases where it was measured it is basic.

The examination of the results presended in Table I shows that it is possible to obtain compositions according to the invention which have good physical stability, a high content of active constituents and good stability of active oxygen.

The introduction of urea into the solvent makes it possible to increase the content of active constituents per unit volume. In effect, liquid $A_3$ contains about 163 g per liter of active constituents while liquid $A_6$ contains about 207 g per liter of active constituents, for the same ratio of Plurafac/Dobanol.

The viscosity values, expressed in centipoises, show that the liquids can be used easily.

An other liquid detergent composition, not shown in the Table I was prepared by introducing into a vessel, while stirring, successively 768 g of water, 156 g of PLURAFAC B26, 12,7 g of triethanolamine, 24,3 g of 70% aqueous solution of hydrogen peroxide. The solution is kept at ambient temperature during 5 days before introducing 39 g of sodium poly-α-hydroxyacrylate (molecular weight 120.000). After 14 days of storage at 32° C the solution is always physically stable and the loss of active oxygen calculated as above is 0,8%/day.

TABLE I

| Liquids | $A_1$ | $A_2$ | $A_3$ | $A_4$ | $A_5$ | $A_6$ | $A_7$ | $A_8$ | $A_9$ |
|---|---|---|---|---|---|---|---|---|---|
| Composition g/kg | | | | | | | | | |
| Solvent: water | 760 | 801 | 843 | 747.7 | 681.5 | 609.7 | 635.4 | 719.4 | 670.3 |
| urea | 0 | 0 | 0 | 66 | 132.4 | 202 | 0 | 0 | 0 |
| Non-ionic surface-active agents | | | | | | | | | |
| Plurafac B 26 | 72.5 | 50.5 | 33.8 | 41 | 41 | 41 | 0 | 0 | 99.2 |
| Ukanyl 75 | 0 | 0 | 0 | 0 | 0 | 0 | 107 | 60.3 | 0 |
| Dobanol 45/11 | 106.5 | 78.5 | 54.4 | 65 | 65 | 66 | 158 | 96.6 | 147.1 |
| Sodium poly-α-hydroxyacrylate (M.wt. = 120,000) | 31 | 47.8 | 51.6 | 62 | 62 | 63 | 0 | 0 | 0 |
| Ammonium poly-α-hydroxyacrylate (M.wt. = 80,000) | 0 | 0 | 0 | 0 | 0 | 0 | 45 | 88.0 | 0 |
| Potassium poly-α-hydroxyacrylate (M.wt. = 120,000) | 0 | 0 | 0 | 0 | 0 | 0 | 0 | 0 | 49.4 |
| Optical bluing agent | 1 | 1 | 0 | 1 | 0.8 | 0.8 | 1.8 | 1.2 | 1.8 |
| Triethanolamine | 8 | 6.2 | 4.5 | 5.4 | 5.4 | 5.4 | 12 | 7.8 | 11.2 |
| 100% strength hydrogen peroxide | 21 | 15 | 12 | 11.9 | 11.9 | 12.1 | 40.6 | 26.1 | 21 |
| Properties | | | | | | | | | |
| Physical stability at 32° C | S | S | S | S | S | S | S | S | S |
| at 43° C | R | R | R | R | R | R | | | |
| Loss of active oxygen at 32° C %/ day | 0.4 | 0.75 | 0.75 | 0.9 | 1.25 | 1.55 | | 0.95 | |
| Specific gravity g/cm³ | | | 1.04 | 1.06 | 1.08 | 1.10 | 1.05 | 1.06 | |
| Viscosity at 25° C cps | 22.7 | 23.3 | 21 | | | | 165 | 231 | |
| pH | 9.4 | 9 | 8.7 | | | | 8 | 7.6 | 9.8 |

EXAMPLE 2

This example compares the washing efficiency of three liquid compositions according to the present invention, of which the compositions have been shown above, namely, liquids $A_1$, $A_2$ and $A_3$, with that of a conventional solid composition serving as a reference, Powder ref. 1, which is sold commercially and of which the composition is given in Table II below. The apparent density of this powder is about 0.5.

TABLE II

| Composition of Powder Ref. 1 | |
|---|---|
| Hydrogenated tallow soap | 3% by weight |
| Anionic surface-active agent | |
| LAS Dobane JN (dodecylbenzene-sulfonate) sold by Shell | 2.5% by weight |
| Non-ionic surface-active agent | |
| Oxyethylated Alfol (long-chain alcohol) (registered trademark | |

TABLE II-continued

| Composition of Powder Ref. 1 | |
|---|---|
| of Continental Oil Co.) | |
| $C_{16}$–$C_{18}$ cut oxyethylated with 50 mols of ethylene oxide | 6% by weight |
| $C_{10}$–$C_{12}$ cut oxyethylated with 5 mols of ethylene oxide | 0.5% by weight |
| Sodium silicate | 10.5% by weight |
| Sodium percarbonate 13.8% of active oxygen | 14.5% by weight |
| Sodium tripolyphosphate | 40% by weight |
| Anhydrous sodium sulfate | 23% by weight |

The washing experiments were carried out in a laboratory Terg-O-tometer washing machine manufactured by U.S. Testing Co., Hoboken, N.J. (U.S.A.), in the presence of either 2 g per liter of Powder ref. 1 or of 4.578 g/l, 5.458 g/l or 7.057 g/l of liquids $A_1$, $A_2$ or $A_3$, respectively, which is equivalent to an identical content of active materials (that is to say, the sum of surface-active agents + builders). The volumes of the Powder ref. 1 and of the liquid $A_1$ were virtually identical.

The washing conditions were as follows:

| | |
|---|---|
| Temperature | 60° C |
| Duration | 10 minutes |
| Speed of stirring | 80 strokes per minute |
| Water employed | hardness : 15 degrees French hardness<br>Ca/Mg ratio : 4/1<br>volume : 1 l |
| Fabric samples to be washed | 5 soiled pieces of the same nature<br>5 unsoiled pieces of the same fabric as the stained pieces |
| Weight of fabric/weight of solution | 1/50. |

The fabric samples to be washed are soiled with lamp-black, mineral pigments and a fatty material. Various types of samples were used: cotton samples prepared, respectively, by EMPA (Switzerland) (cotton 1), WFK Krefeld (West Germany) (cotton 2), and TEST FABRICS (U.S.A.) (cotton 3), as well as samples of polyester-cotton, polyamide and cellulose acetate manufactured by TEST FABRICS (U.S.A.)

The effect of the washing treatment on the various samples is measured by the variation in their whiteness. The whiteness is measured by means of an RFC 3 (Zeiss) reflectometer equipped with a green trichromatic filter standardized by the CIE (Commission Internationale de l'Eclairage). The values obtained for the reflectances are shown as absolute reflectance.

For each stained sample, the degree of removal of the soiling, in %, that is to say, the ratio $$\frac{\text{soiling removed}}{\text{soiling to be removed}} \times 100 \text{ is given by the equation:}$$

$$\frac{\text{reflectance after washing} - \text{reflectance before washing}}{\text{initial reflectance (before staining)} - \text{reflectance before washing}} \times 100.$$

The mean degree of removal of the soiling is equal to the arithmetic mean of the results for all the samples of one and the same type.

Each series of samples were subjected to three successive washes. The detailed results of these experiments are shown in Table III below. The mean result is given in Table IV.

TABLE III

| Detergent | Degree of removal of soiling, % | | | | | |
|---|---|---|---|---|---|---|
| | Cotton 1 | Cotton 2 | Cotton 3 | $P^E$/cotton | Polyamide | Acetate |
| | | | 1st wash | | | |
| Powder ref. 1 | 37.6 | 31.2 | 7.6 | 9.7 | 32.2 | 10.7 |
| Liquid $A_1$ | 15.1 | 32.2 | 6.2 | 11.8 | 32.1 | 24.9 |
| Liquid $A_2$ | 16.1 | 31.0 | 8.5 | 12.0 | 23.7 | 25.6 |
| Liquid $A_3$ | 29.7 | 34.8 | 9.0 | 15.0 | 28.9 | 24.4 |
| | | | 2nd wash | | | |
| Powder ref. 1 | 45.2 | 50.7 | 16.3 | 12.6 | 40.7 | 16.1 |
| Liquid $A_1$ | 20.0 | 45.5 | 12.0 | 18.0 | 43.2 | 34.3 |
| Liquid $A_2$ | 22.1 | 43.6 | 13.1 | 17.9 | 40.5 | 34.0 |
| Liquid $A_3$ | 34.6 | 50.7 | 15.5 | 21.5 | 45.0 | 32.8 |
| | | | 3rd wash | | | |
| Powder ref. 1 | 48.6 | 61.3 | 21.6 | 15.1 | 45.2 | 19.4 |
| Liquid $A_1$ | 22.1 | 54.4 | 14.7 | 22.7 | 49.8 | 39.8 |
| Liquid $A_2$ | 24.4 | 52.1 | 15.6 | 22.0 | 48.6 | 39.1 |
| Liquid $A_3$ | 36.4 | 59.6 | 18.5 | 25.5 | 52.0 | 37.4 |

TABLE IV

Mean result of the washes

| Detergent | Degree of removal of soiling, % | | | | | |
|---|---|---|---|---|---|---|
| | Cotton 1 | Cotton 2 | Cotton 3 | PE/cotton | Polyamide | Acetate |
| Powder ref. 1 | 43.8 | 47.8 | 15.2 | 12.5 | 39.4 | 15.4 |
| Liquid $A_1$ | 19.0 | 44.0 | 11.0 | 17.5 | 41.7 | 33.0 |
| Liquid $A_2$ | 20.8 | 42.2 | 12.4 | 17.3 | 37.6 | 32.9 |
| Liquid $A_3$ | 33.6 | 48.4 | 14.3 | 20.7 | 42.0 | 31.5 |

A statistical analysis of the results obtained on the soiled samples, on the basis of 95% probability, shows that the mean efficiency of the four detergents is identical. As regards the effect of each of the detergents on the different types of soiling, it is found that the liquids $A_1$, $A_2$ and $A_3$ are much more efficient for washing soiled polyester-cotton and cellulose acetate than the reference powder. On cotton 2, cotton 3 and the polyamide, the efficiency of the four detergents is comparable. It is only in the case of cotton 1 that the efficiency of the liquids $A_1$, $A_2$ and $A_3$ proves to be less than that of the reference powder.

The washing experiments described above were carried out in the presence of unsoiled fabric samples of the trademark TEST FABRICS, i.e., cotton 3, polyester-cotton, polyamide and cellulose acetate, in order to evaluate the soil redeposition.

The detailed results of these experiments are shown in Table V, while the means result is shown in Table VI.

TABLE V

| Detergent | Degree of removal of soiling, % | | | |
|---|---|---|---|---|
| | Cotton 3 | Polyester-cotton | Polyamide | Acetate |
| | | 1st wash | | |
| Powder ref. 1 | 1.6 | 0.0 | −2.4 | −1.0 |
| Liquid $A_1$ | 3.5 | 1.8 | −0.4 | −0.0 |
| Liquid $A_2$ | 3.5 | 1.7 | −1.5 | −0.1 |
| Liquid $A_3$ | 4.8 | 1.2 | −1.5 | 0.2 |
| | | 2nd wash | | |
| Powder ref. 1 | 1.1 | −0.4 | −3.1 | −1.3 |
| Liquid $A_1$ | 4.3 | 1.4 | −2.0 | −0.6 |
| Liquid $A_2$ | 4.6 | 0.6 | −2.3 | −0.4 |
| Liquid $A_3$ | 5.0 | 0.3 | −1.6 | −0.4 |
| | | 3rd wash | | |
| Powder ref. 1 | 0.5 | −0.5 | −3.3 | −1.6 |
| Liquid $A_1$ | 5.6 | 1.4 | −2.0 | −0.8 |
| Liquid $A_2$ | 5.2 | 0.8 | −2.4 | −0.3 |
| Liquid $A_3$ | 5.9 | 0.7 | −1.6 | −0.3 |

TABLE VI

| Mean result of the washes | | | | |
|---|---|---|---|---|
| | Degree of removal of soiling, % | | | |
| Detergent | Cotton 3 | Polyester-cotton | Polyamide | Acetate |
| Powder ref. 1 | 1.1 | −0.3 | −2.9 | −1.3 |
| Liquid $A_1$ | 4.5 | 1.5 | −1.5 | −0.5 |
| Liquid $A_2$ | 4.5 | 1.0 | −2.0 | −0.2 |
| Liquid $A_3$ | 5.2 | 0.7 | −1.6 | −0.2 |

The same type of statistical analysis as that which was applied to the results obtained for the soiled samples shows that, in the case of the unsoiled fabric samples, the three liquids $A_1$, $A_2$ and $A_3$ have, on average, a better anti-redeposition power than the powder. As regards the effect of each of the detergents on the various types of carriers, it is found that the anti-redeposition power of the liquids $A_1$, $A_2$ and $A_3$ is much better than that of the powder in the case of cotton 3.

The anti-redeposition efficiency of the same liquids when washing polyester-cotton, polyamide and cellulose acetate is barely less good than that of the powder.

It will be understood that the above description of the present invention is susceptible to various modifications, changes and adaptations, and the same are intended to be comprehended within the meaning and range of equivalents of the appended claims.

What is claimed is:

1. A stable liquid detergent composition made of an equeous solvent and from 5 to 60% by weight of active constitutents comprising (a) a peroxidic compound selected from the group consisting of hydrogen peroxide and the organic and inorganic addition products of hydrogen peroxide, with the concentration of alkali metal ions in the free state not exceeding 10 g per kg of solvent, (b) at least one surface-active agent and (c) a stabilizer which is a salt, of an organic or inorganic base and of a polymer derived from an alpha-hydroxyacrylic acid, which salt contains units of the formula

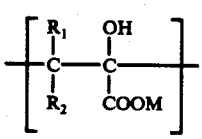

where $R_1$ and $R_2$ independently represent hydrogen atoms or alkyl groups containing from 1 to 3 carbon atoms which may or may not be substituted and where M represents a cationic radical resulting from the dissociation of said base, with the average molecular weight of the polymer being greater than about 300.

2. The composition according to claim 1, wherein the salt of a polymer derived from an alpha-hydroxyacrylic acid contains at least 50 mol % of units of the formula

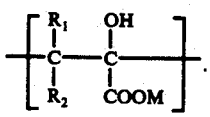

3. The composition according to claim 2, wherein the salt of a polymer derived from an alpha-hydroxyacrylic acid only contains units of the formula

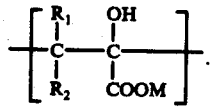

4. The composition according to claim 1 and further containing at least one non-ionic surface-active agent.

5. The composition according to claim 1, wherein the peroxide derivative is hydrogen peroxide.

6. The composition according to claim 1, wherein the solvent is water.

7. The composition according to claim 1, wherein the composition contains, by weight of active substance, from 0.1 to 30% by weight of hydrogen peroxide, taken as 100 strength, from 20 to 95% by weight of a surface-active agent, and from 0.5 to 50% by weight of a salt of a polymer.

8. The composition according to claim 1, wherein the average molecular weight of the polymer is between 2,000 and 1,000,000.

9. The composition according to claim 1, wherein the average molecular weight of the polymer is between about 5,000 and about 800,000.

10. The composition according to claim 1 wherein the aqueous solvent contains at least 50% by weight of water.

11. The composition according to claim 1, wherein the salt is derived from an inorganic base.

12. The composition according to claim 11, wherein the salt is an ammonium salt.

13. The composition according to claim 12, wherein the salt is an ammonium poly-alpha-hydroxyacrylate.

14. The composition according to claim 11, wherein the salt is an alkali metal salt.

15. The composition according to claim 14, wherein the alkali metal salt is a sodium salt.

16. The composition according to claim 15, wherein the salt is a sodium poly-alpha-hydroxyacrylate.

17. The composition according to claim 14, wherein the alkali metal salt is a potassium salt.

18. The composition according to claim 17, wherein the salt is a potassium poly-alpha-hydroxyacrylate.

* * * * *